US010021507B2

(12) United States Patent
Mehnert et al.

(10) Patent No.: US 10,021,507 B2
(45) Date of Patent: Jul. 10, 2018

(54) ARRANGEMENT AND METHOD FOR REPRODUCING AUDIO DATA OF AN ACOUSTIC SCENE

(71) Applicant: Barco NV, Kortrijk (BE)

(72) Inventors: Markus Mehnert, Heringen (DE); Robert Steffens, Baunatal (DE); Martin Dausel, Erfurt (DE); Henri Meissner, Lüneberg (DE)

(73) Assignee: BARCO NV, Kortrijk (BE)

( * ) Notice: Subject to any disclaimer, the term of this patent is extended or adjusted under 35 U.S.C. 154(b) by 0 days.

(21) Appl. No.: 14/893,309

(22) PCT Filed: May 23, 2014

(86) PCT No.: PCT/EP2014/060693
§ 371 (c)(1),
(2) Date: Nov. 23, 2015

(87) PCT Pub. No.: WO2014/187971
PCT Pub. Date: Nov. 27, 2014

(65) Prior Publication Data

US 2016/0119737 A1 Apr. 28, 2016

(30) Foreign Application Priority Data

May 24, 2013 (EP) ..... 13169251

(51) Int. Cl.
*H04S 7/00* (2006.01)
*H04S 5/00* (2006.01)
*H04R 5/04* (2006.01)

(52) U.S. Cl.
CPC ..... *H04S 7/306* (2013.01); *H04S 7/303* (2013.01); *H04R 5/04* (2013.01); *H04S 2400/11* (2013.01); *H04S 2420/01* (2013.01)

(58) Field of Classification Search
CPC ..... G10L 19/008; G10L 19/24; H04S 24/003; H04S 3/008; H04S 2400/01; H04S 5/00
See application file for complete search history.

(56) References Cited

U.S. PATENT DOCUMENTS 6,498,857 B1 * 12/2002 Sibbald ..... H04S 7/30 381/1
9,094,771 B2 7/2015 Tsingos et al.
(Continued)

FOREIGN PATENT DOCUMENTS

KR 100818660 B1 4/2008
WO WO-2011/068192 A1 6/2011
WO WO-2012/145176 A1 10/2012

OTHER PUBLICATIONS

International Search Report for PCT/EP2014/060692, ISA/EP, Rijswijk, NL, dated Sep. 18, 2014.

*Primary Examiner* — Sonia Gay
(74) *Attorney, Agent, or Firm* — Harness, Dickey & Pierce, PLC

(57) ABSTRACT

An arrangement, for reproducing audio data of an acoustic scene, adapted for generating audio signals for at least a first and a second headphone channel of a headphone assembly, the audio signals corresponding to at least one audio object and/or sound source in the acoustic scene comprising at least one given close range and at least one given distant range arranged around a listener, the arrangement comprising a first headphone channel; a second headphone channel; a basic channel provider comprising at least a basic system adapted for reproducing audio signals corresponding to at least one audio object and/or sound source arranged in at least one distant range; a proximity channel provider comprising at least a proximity system adapted for reproducing audio signals corresponding to at least one audio object and/or sound source arranged in at least one close range.

13 Claims, 7 Drawing Sheets

(56) References Cited

U.S. PATENT DOCUMENTS

| | | | | |
|---|---|---|---|---|
| 2010/0226506 | A1* | 9/2010 | Bayes | H04R 5/023 381/86 |
| 2011/0200196 | A1* | 8/2011 | Disch | H04S 7/30 381/22 |
| 2012/0237037 | A1* | 9/2012 | Ninan | H04S 7/304 381/17 |
| 2014/0037117 | A1 | 2/2014 | Tsingos et al. | |

* cited by examiner

ARRANGEMENT AND METHOD FOR REPRODUCING AUDIO DATA OF AN ACOUSTIC SCENE

CROSS REFERENCE TO RELATED APPLICATIONS

This application is a 371 U.S. National Stage of International Application No. PCT/EP2014/060693, filed May 23, 2014, which claims the benefit of and priority to European Patent Application No. 13169251.9, filed May 24, 2013. The entire disclosures of the above applications are incorporated herein by reference.

TECHNICAL FIELD

The invention relates to an arrangement and a method for reproducing audio data, in particular for driving a first headphone channel and a second headphone channel to a headphone assembly corresponding to at least one audio object and/or one sound source in a given environment.

BACKGROUND OF THE INVENTION

Multi-channel signals may be reproduced by three or more speakers, for example, 5.1 or 7.1 surround sound channel speakers to develop two-dimensional (2D) and/or three-dimensional (3D) effects.

Conventional surround sound systems can produce sounds placed nearly in any direction with respect to a listener positioned in a so called sweet spot of the system. However, conventional 5.1 or 7.1 surround sound systems do not allow for reproducing auditory events that the listener perceives in a close distance to his head. Several other spatial audio technologies like Wave Field Synthesis (WFS) or Higher Order Ambisonics (HOA) systems are able to produce so called focused sources, which can create a proximity effect using a high number of loudspeakers for concentrating acoustic energy at a determinable position relative to the listener.

Channel-based surround sound reproduction and object-based scene rendering are known in the art. Several surround sound systems exist that reproduce audio with a plurality of loudspeakers placed around the so called sweet spot. The sweet spot is the place where the listener should be positioned to perceive an optimal spatial impression of the audio content. Most conventional systems of this type are regular 5.1 or 7.1 systems with 5 or 7 loudspeakers positioned on a rectangle, circle or sphere around the listener and a low frequency effect channel. The audio signals for feeding the loudspeakers are either created during the production process by a mixer (e.g. motion picture sound track, music sound track) or they are generated in real-time, e.g. in interactive gaming scenarios or from other object based scenes.

FIG. 1 shows a well-known reproduction system which comprises a surround system with a number of loudspeakers 4.1 to 4.5 and at least two loudspeaker bars 5.1 and 5.2 arranged around a position X of a listener L in an environment 1, e.g. in a room, to reproduce audio signals, e.g. motion picture sound track, music sound track, interactive gaming scenarios, and thus an acoustic scene 2 for the listener L in the room: Whereas the surround system produces distant sound effects and the loudspeaker bars 5.1 and 5.2 produce the effects close to the listener L.

The document KR 100 818 660 B1 describes a 3D sound generation system for a model in a near field to improve the immersion for a virtual reality by modelling for a far ear and a near ear in the near field with a different method. A 3D sound generation system for a model in a near field includes a far ear processing unit and a near ear processing unit. The far ear processing unit processes a sound source reached in an ear positioned at a far side among the sound source generated in the near field. A high pass filter having a cut-off frequency of 2-5 KHz is included at the far ear processing unit for attenuating a high frequency. The near ear processing unit processes a sound source reached in an ear positioned at a near side among the sound source generated in the near field.

The document WO 2011/068192 A1 provides an acoustic space which realizes the movement of sound from inside the human body to outside of the human body, or reversely, from outside of the human body to inside of the human body. A sound output device mountable near the ear is used as the output means for internal sound positioned in the human head, and an externally located sound output device is used as the output means for external sound; the spatial effect of the sound is implemented as the acoustic space between inside and outside of the body. The acoustic conversion device is provided with a sound signal generation device, at least one internal sound output device mountable near the ear of a listener, and at least one external sound output device positioned at a distance from the listener. The internal sound output devices and the external sound output devices are capable of simultaneous output, and said devices output different sound information such that the listener can listen to sound from the internal sound output device and the external sound output device.

SUMMARY OF THE INVENTION

It is an object of the present invention to provide an arrangement and a method with an improved reproduction of audio data of an acoustic scene by a first and a second headphone each driven by a plurality of channels to develop multidimensional, in particular two- or three-dimensional sound effects.

The object is achieved by an arrangement for providing a first headphone channel and a second headphone channel to a headphone assembly according to claim 1 and by a method for providing a first headphone channel and a second headphone channel to a headphone assembly according to claim 8.

Preferred embodiments of the invention are given in the dependent claims.

According to the invention an arrangement for reproducing audio data of an acoustic scene in a given environment for driving at least a first headphone channel and a second headphone channel to a headphone assembly corresponding to at least one audio object and/or at least one sound source in the acoustic scene subdivided into at least one distant range and into at least one close range, e.g. for generating audio signals for the at least first and second headphone channels, is provided wherein the arrangement comprises:

first headphone channel;

second headphone channel;

a basic channel provider;

a proximity channel provider, wherein:

the basic channel provider is configured to provide a first basic effect channel and a second basic effect channel of a basic system to create at least one basic audio signal corresponding to at least one distant range, in particular the basic channel provider comprising at least a basic system adapted for reproducing audio signals corresponding to at least one audio object and/or sound source arranged in at least one distant range;

the proximity channel provider is configured to provide a first proximity effect channel and a second proximity effect channel of a proximity system to create at least one proximity audio signal corresponding to at least one close range, in particular the proximity channel provider is adapted for reproducing audio signals corresponding to at least one audio object and/or sound source arranged in at least one close range; and wherein the first headphone channel is driven by the first basic effect channel and the first proximity effect channel; and the second headphone channel is driven by the second basic effect channel and the second proximity effect channel.

The first and second headphone channels correspond with an extended virtual 2D or 3D sound effect in such a manner that a given virtual or real audio object and/or sound source in a space of a virtual and/or real acoustic scene relative to a position of a listener in the acoustic scene and/or the environment is reproduced with perception of the distance (on a distant or close range or between both ranges and thus any distance between far away and close) and/or the direction (in an angular position to the listener's position and respectively on the first and/or the second headphone channel=on the left and/or the right ear).

In an exemplary embodiment, the acoustic scene comprises at least one given close range and at least one given distant range arranged around a listener.

In an exemplary embodiment, the basic system is adapted for reproducing audio signals corresponding to at least one audio object and/or sound source arranged in at least one distant range. The proximity system is adapted for reproducing audio signals corresponding to at least one audio object and/or sound source arranged in at least one close range.

In an exemplary embodiment, an audio object is a spatially distributed acoustic emission source emitting sound with a determined emission characteristics, as for example an emission direction and dampening. A real audio object may be given for example as a person speaking or a music instrument playing music. A virtual audio object may correspond to a virtual scene, such as a figure in a video game or a synthesised background noise. In an exemplary embodiment, a sound source is an acoustic point source emitting sound from a determined position within the acoustic scene. A sound source may be given for example by a loudspeaker, a sound machine or other real sound sources.

The arrangement may be used in interactive gaming scenarios, movies and/or other PC applications in which multidimensional, in particular 2D or 3D sound effects are desirable. In particular the arrangement allows 2D or 3D sound effects, in particular proximity effects as well as basic or distant effects generating in a headphone assembly which are very close to the listener as well as far away from the listener or any range between. For this purpose, the acoustic environment and/or the acoustic scene are subdivided into a given number of distant ranges and close ranges. For example, in interactive gaming scenarios, windy noises might be generated far away from the listener in at least one given distant range wherein voices might be generated only in one of the listener's ear or close to the listener's ear in at least one given close range. In other scenarios, the audio object and/or the sound source move around the listener in the respective distant and/or close ranges using panning between the different close or far acting audio systems, in particular panning, e.g. blending between the basic system and the proximity system, so that it appears to the listener that the sound comes from any position in the space, wherein panning denotes the spread of a monaural acoustic signal or a pair of stereophonic acoustic signals into a plurality of new acoustic signals, for example into a pair of new stereophonic acoustic signals. In particularity, panning may be implemented as blending between the basic system and the proximity system such that the listener perceives the movement of an audio object and/or a sound source within the acoustic scene. Further, a movement of the listener, e.g. a head movement, could be considered during providing the first and second headphone channels wherein the generated first and second headphone channels are accordingly tracked with the head position of the listener.

In an exemplary embodiment, the basic system and the proximity system are adapted to process respective panning information of the same audio object and/or the same sound source by panning this audio object and/or this sound source between the basic system and the proximity system, in particular in such a manner that this audio object and/or this sound source is panned within one of the close or distant ranges or between different ranges.

In a possible embodiment, the basic system is a computer-implemented system comprising head related transfer functions (HRTF) and/or binaural room impulse responses (BRIR) based basic system which represents how a sound from a distant point in the given environment is received at the listener's ears. The basic channel provider is a 2D or 3D channel provider adapted to provide the first and second basic effect channels using respective head related transfer functions and/or binaural room impulse responses for basic system perception to generate an audio signal, in particular a basic audio signal, for the respective first and second headphone channels, the audio signal being adapted for panning at least one audio object and/or at least one sound source to a respective angular position and with a respective intensity in the distant range of the listener for the respective first and second headphone channels. The head related transfer functions and binaural room impulse responses of the basic system for the headphone assembly are given, in particular measured.

In a possible embodiment, the proximity system is a computer-implemented system comprising a HRTF/BRIR based proximity system which represents how a sound from a close point in the given environment is received at the listener's ears. The proximity channel provider is a 2D or 3D channel provider is adapted to provide the first and second proximity effect channels using respective head related transfer functions and/or binaural room impulse responses for proximity system perception to generate or create a proximity audio signal for the respective first and second headphone channels, the audio signal being adapted for panning at least one audio object and/or at least one sound source to a respective angular position and with a respective intensity in the close range of the listener for the respective first and second headphone channels. The head related transfer functions and the binaural room impulse responses of the proximity system for the headphone assembly are given, in particular measured.

In an alternative embodiment, the proximity channel provider is adapted to process so-called direct audio signals of an audio object and/or from at least one sound source, e.g. audio signals from sound bars, to create an audio signal of the audio object and/or the sound source in a respective close range of the listener, in particular to provide the first and second proximity effect channels for a close perception in the respective first and second headphone channels.

To give feasible proximity sound effects and to achieve a natural perception of the audio object and/or the sound source at the ears of the listener, audio processing units, in particular delay units and filters, are provided to adapt the so-called direct audio signals for the first and second proximity effect channels and thus for a close perception in the first and second headphone channels. These result in such a sound effect at the ears of the listener that the audio object and/or the sound source is reproduced at the left ear as well as at the right ear of the listener with different intensities so that a natural perception of the audio object and/or the sound source is achieved. In particular, for a sound source in a space of an acoustic scene coming from the left side of the listener an audio signal for the respective left headphone channel is created with more intensity and other spectral properties than for the right headphone channel. By that difference of intensities and spectral properties natural perception is achieved.

To improve multidimensional, 2D or 3D, sound effects for the listener and depending on the kind of the headphone assembly and/or the availability of real audio facilities, the driving of the first and second headphone channels of the headphone assembly may be additionally supported by further different audio systems wherein each audio system may create only one or more than one of the defined distant and close ranges of the acoustic environment.

In particular, the arrangement may comprise a headphone assembly in combination with another real or virtual audio system, such as a surround system and/or a proximity system spatially or distantly arranged from the listener, wherein the headphone assembly creates a respective close range and the proximity system creates another and/or the same close range as the headphone assembly for a close perception and the surround systems creates the respective distant range for a distant perception.

In an exemplary embodiment, the basic system further comprises a surround system, e.g. a 5.1 or 7.1 surround system, arranged in the given environment with at least three loudspeakers, wherein the basic channel provider is a surround channel provider for providing the first and second basic effect channels by generating an audio signal for the respective loudspeakers of the surround system corresponding to theat least one audio object and/or from at least one sound source panned to at least one distant range.

In particular, the surround system might be designed as a virtual or spatially arranged audio system, e.g. a home entertainment system such as a 5.1 or 7.1 surround system, which is combined with an open-backed headphone to generate multidimensional, e.g. 2D sound effects in different scenarios wherein sound sources and/or audio objects far away from the listener are generated by the surround system in one of the distant ranges and sound sources and/or audio objects close to the listener are generated in one of the close ranges by the headphone assembly. Using panning information allows that a movement of the audio objects and/or the sound sources in the acoustic environment between the different close and distant ranges results in a changing listening perception of the distance to the listener and also results in a respective driving of the headphone assembly as well as the basic system. The surround system might be designed as a virtual or spatially or distantly arranged surround system wherein the virtual surround system is simulated in the given environment by a computer-implemented system and the real surround system is arranged in a distance to the listener in the given environment.

In another exemplary embodiment, the proximity system is at least one sound bar comprising a plurality of loudspeakers to provide an audio signal for panning at least one audio object and/or at least one sound source to a respective angular position and with a respective intensity in the close range of the listener for the respective sound bar for a further close perception. In particular, two sound bars are provided wherein one sound bar covers the left side of the listener and the other sound bar covers the right side of the listener. The proximity system might be designed as a virtual or distally arranged proximity system wherein the sound bars of a virtual proximity system are simulated by a computer-implemented system in the given environment and the sound bars of a real proximity system are arranged in a distance to the listener.

According to panning information of the audio object and/or the sound source, e.g. their position in the acoustic scene, in particular their angular position and/or their distance to the listener, the audio object and/or the sound source is panned within one of the close or distant ranges or between the different ranges to create the basic effect channel and the proximity effect channel by driving, e.g. blending, between the audio channels of the audio systems, e.g. of the head assembly as well as of the proximity system and/or of the basic system.

According to another aspect of the invention, a method for reproducing audio data of an acoustic scene in a given environment for driving at least a first headphone channel and a second headphone channel to a headphone assembly corresponding to at least one audio object and/or at least one sound source in a given environment, in particular for generating audio signals for at least a first headphone channel and a second headphone channel of a headphone assembly (3), with the audio signals corresponding to at least one audio object and/or at least one sound source, is provided, wherein the method comprises the following steps:

subdividing the acoustic scene and/or the environment into at least one distant range and into at least one close range;

providing a first headphone channel;

providing a second headphone channel; wherein a basic channel provider provides a first basic effect channel and a second basic effect channel of a basic system to create at least one distant range, in particular at least one basic audio signal corresponding to the at least one distant range;

a proximity channel provider provides a first proximity effect channel and a second proximity effect channel of a proximity system to create at least one close range, in particular at least one proximity audio signal corresponding to the at least one close range; and wherein the first headphone channel is driven by the first basic effect channel and the first proximity effect channel; and the second headphone channel is driven by the second basic effect channel and the second proximity effect channel.

In an exemplary embodiment, the basic channel provider formed as a 2D or 3D channel provider provides the first and second basic effect channels using respective head related transfer functions (HRTF) and/or binaural room impulse responses (BRIR) to generate an audio signal for the respective first and second headphone channels, with the audio signal adapted for panning at least one audio object and/or at least one sound source in at least one distant range of the listener for the respective first and second headphone channels.

In an exemplary embodiment, the proximity channel provider formed as a 2D or 3D channel provider provides the first and second proximity effect channels using respective head related transfer functions (HRTF) and/or binaural room impulse responses (BRIR) to generate an audio signal for panning at least one audio object and/or at least one sound source in at least one close range of the listener for the respective first and second headphone channels.

In an alternative embodiment, the proximity channel provider calculates direct audio signals, e.g. audio signals from sound bars, for panning at least one audio object and/or at least one sound source in a close range of the listener for providing the first and second proximity effect channels for the respective first and second headphone channels.

To improve the feasibility of the 2D or 3D sound effects, the direct audio signals for the first proximity effect channel are delayed with respect to the direct audio signals for the second proximity effect channel and/or are created with more or less intensity as the direct audio signals for the second proximity effect channel or vice versa. This enables to give different proximity effects and sound impressions of the audio object and/or the sound source onto the first and the second headphone channels similar to a natural acoustic, in particular distant and close perception.

To support the 2D or 3D sound effects generated onto the headphone assembly by at least one spatially or distantly arranged audio system, the basic channel provider additionally formed as a surround channel provider provides the first and second basic effect channels by generating an audio signal for panning at least one audio object and/or at least one sound source in a distant range of the listener for the respective loudspeakers of the spatial arranged audio system, in particular the surround system.

According to another aspect of the invention, a computer-readable recording medium having a computer program for executing the method described above.

Further, the above described arrangement is used to execute the method in interactive gaming scenarios, software scenarios or movie scenarios, in particular for reproducing audio data corresponding to interactive gaming scenarios, software-scenarios, simulated environments.

Further, a headphone assembly provided with an arrangement described above forms a multi-depth headphone.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus, are not limitive of the present invention.

Corresponding parts are marked with the same reference symbols in all figures.

DETAILED DESCRIPTION OF PREFERRED EMBODIMENTS

Figure 1:
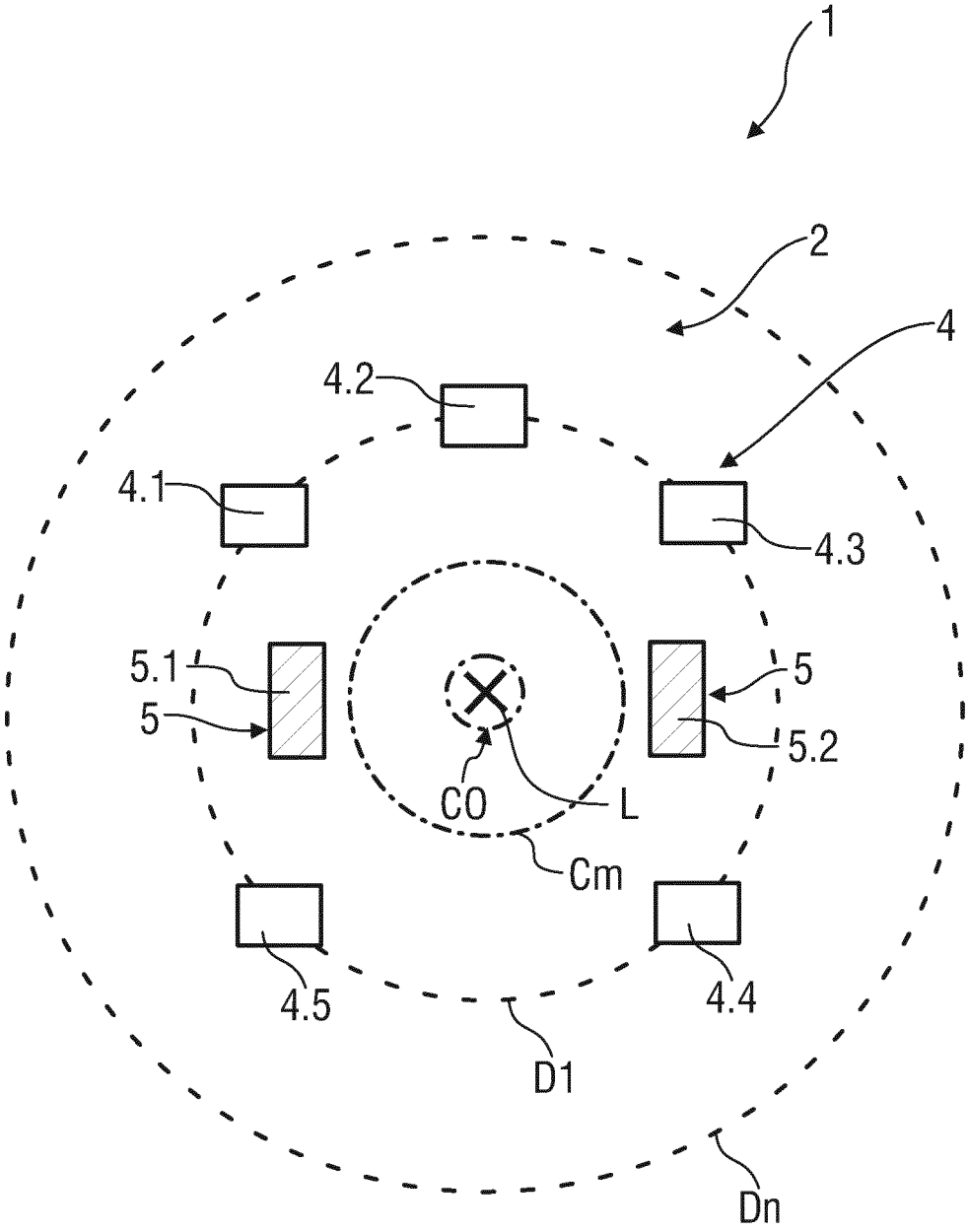
FIG 1 Prior Art
FIG. 1 shows an arrangement for reproduction of audio data of an acoustic scene as it is known in the prior art and as it is described above.
Figure 2:
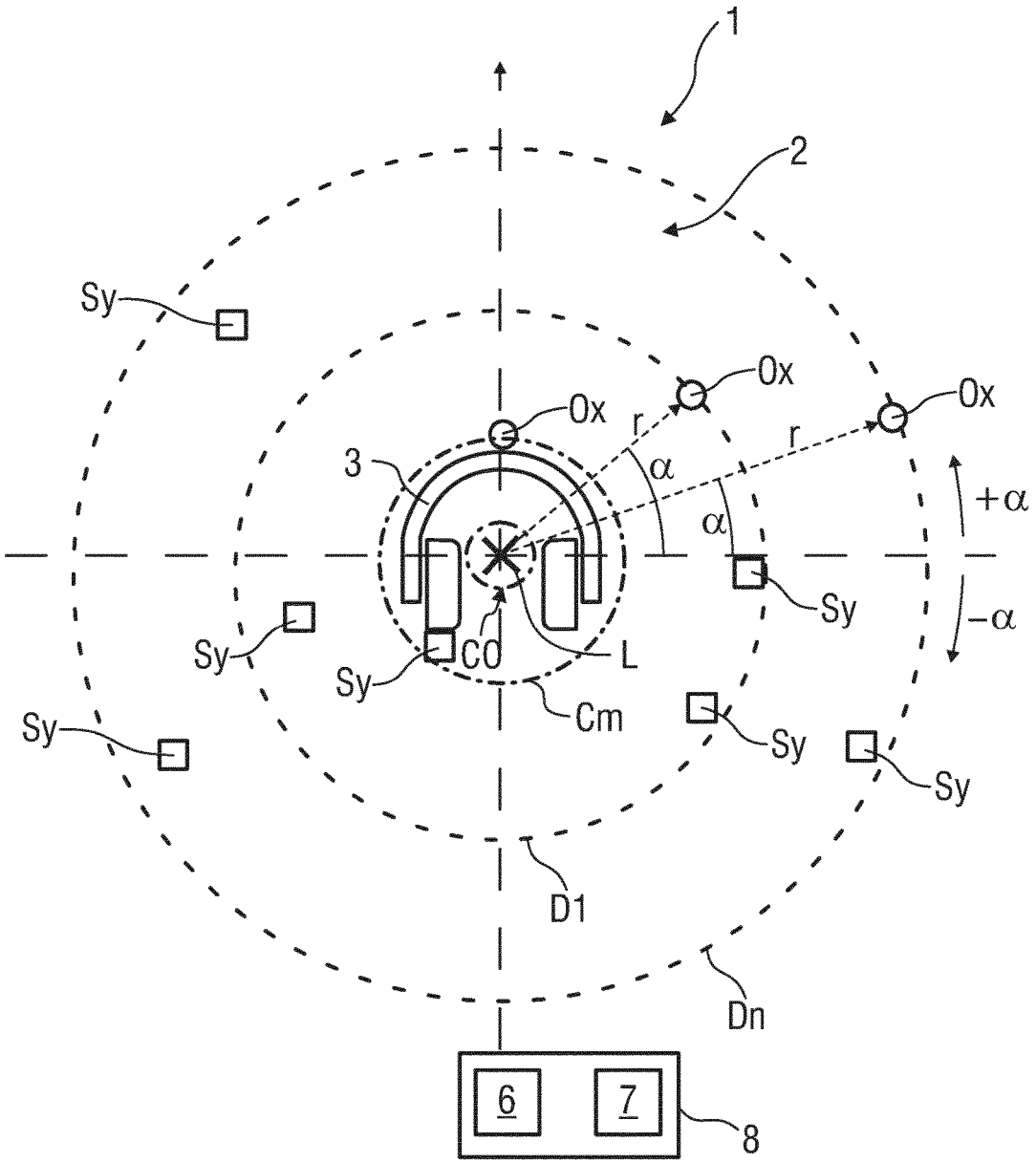
FIG. 2 shows an exemplary embodiment of an environment of an acoustic scene comprising different distant and close ranges around a position of a listener wherein the acoustic scene is only reproduced on a headphone assembly.

FIG. 2 shows an exemplary environment 1 of an acoustic scene 2 comprising different distant ranges D1 to Dn and close ranges C0 to Cm around a position X of a listener L.

The environment 1 may be a real or virtual space, e.g. a living room or a space in a game or in a movie or in a software scenario, e.g. in a motion picture sound track, music sound track, in interactive gaming scenarios or in other object based scenarios.

The acoustic scene 2 comprises at least one audio object Ox, e.g., voices of persons, wind, noises of audio objects, generated in the virtual environment 1. Additionally or alternatively, the acoustic scene 2 comprises at least one sound source Sy, e.g. loudspeakers, generated in the environment 1.

According to the invention, the listener L uses a headphone assembly 3, e.g. an open-backed headphone or a closed-backed headphone.

Depending on panning information of the audio object Ox and/or the sound source Sy in the acoustic scene 2, the audio object Ox and/or the sound source Sy are panned to at least one of the respective acoustic ranges, in particular to one of the distant ranges D1 to Dn and/or the close ranges C0 to Cm and/or between them. In particular, according to the panning information the audio object Ox and/or the sound source Sy are respectively reproduced on the headphone assembly 3 in a given angular position $\alpha$ and in a given distance r to the position X of the listener L within at least one of the close or distant ranges C0 to Cm and D1 to Dn and with a respective intensity.

In the case of a closed-backed headphone assembly 3, e.g. in-ear headphones, the acoustic scene 2 and thus the audio objects Ox and/or the sound sources Sy are generated by an audio reproduction arrangement 8 comprising a computer program, e.g. using an HRTF/BRIR based system which represents how a sound from a distant and/or close point in the given environment 1 is received at the listener's ears. The audio reproduction arrangement 8 comprises a basic channel provider 6 and a proximity channel provider 7. In this exemplary embodiment, the basic channel provider 6 comprises a computer-implemented basic system 4, e.g. a virtual surround system, with a distant HRTF/BRIR based system 4-HRTF for generating distant sound effects for basic system perception, e.g. at least one basic audio signal corresponding to at least one distant range D1 to Dn, and the proximity channel provider 7 comprises a computer-implemented proximity system 5, e.g. a virtual loudspeaker bar, with a close HRTF/BRIR based system 5-HRTF for generating proximity sound effects for proximity system perception, e.g. at least one proximity audio signal corresponding to at least one close range C0 to Cm (shown in FIG. 6 in more detail).

In general, the basic system 4 is adapted for reproducing audio signals corresponding to at least one audio object Ox and/or sound source Sy arranged in at least one distant range D1 to Dn, wherein the proximity system 5 is adapted for reproducing audio signals corresponding to at least one audio object Ox and/or sound source Sy arranged in at least one close range C0 to Cm.

The head related transfer functions and/or or binaural room impulses 4-HRTF of the computer-implemented basic system 4 for the headphone assembly 3 are given, in particular measured. The head related transfer functions and/or binaural room impulse responses 5-HRTF of the proximity system 5 are also given, in particular measured, too.

Alternative to the HRTF/BRIR based proximity system, the proximity system 5 (shown in FIG. 6 in more detail) is a computer-implemented system, too, which is adapted to process direct audio signals DAS1, DAS2 (shown in FIG. 7) of the audio object Ox and/or the sound source Sy to generate audio signals in the close range C0 to Cm to drive the headphone assembly 3.

To achieve natural distant and close perception of the audio object Ox and/or the sound source Sy at the ears of the listener L via the headphone assembly 3, an audio object Ox in a given distance r and in a given angular position $\alpha$ relative to the listener L is reproduced with perception of the distance r and/or the direction by panning the object Ox to the respective angular position $\alpha$ and with a respective intensity within or between the respective close or distant ranges C0 to Cm, D1 to Dn on the headphone assembly 3. Hence, the headphone assembly 3 designed according to embodiment of FIG. 2 forms a multi-depth headphone.

Figure 3:
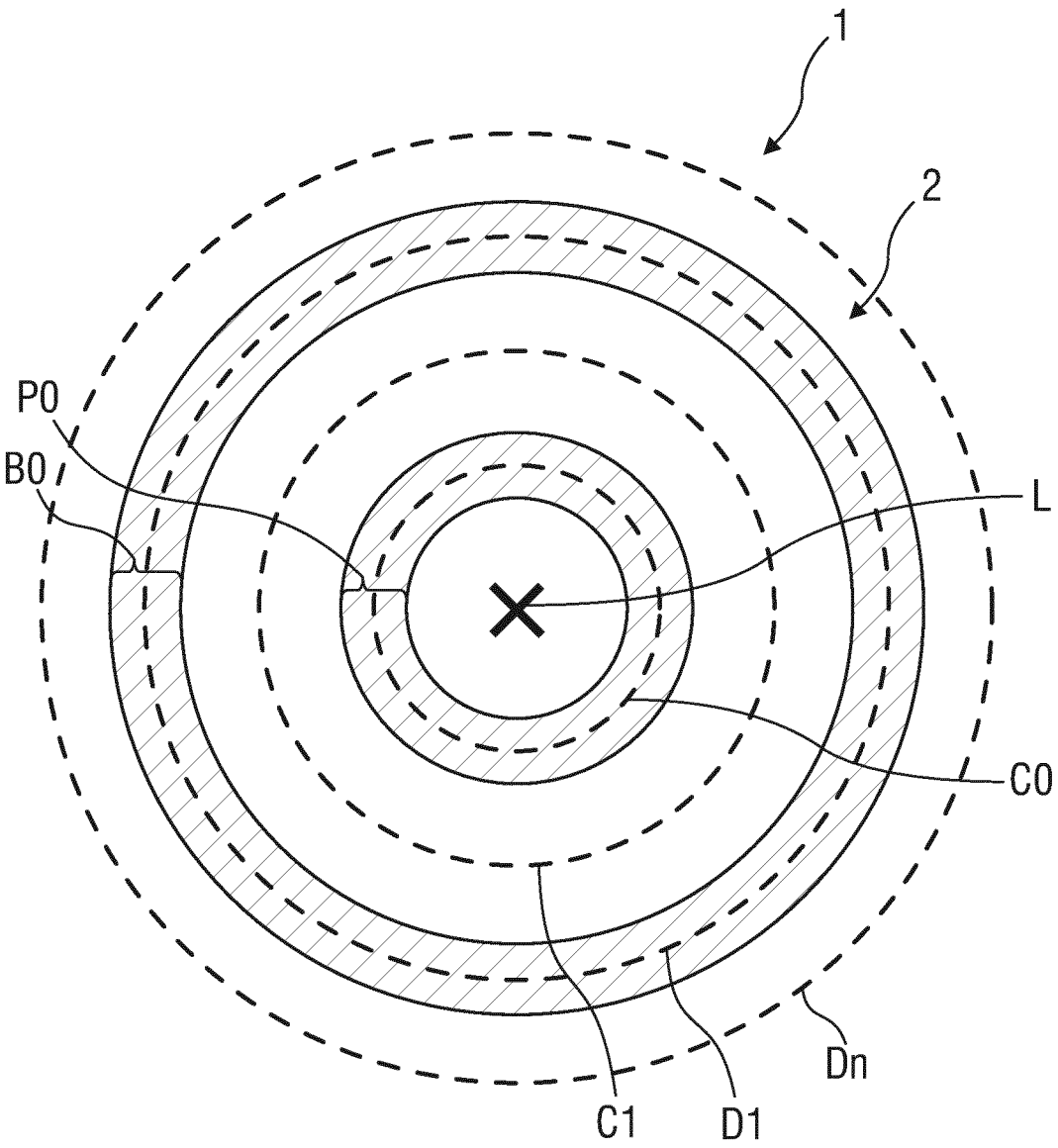
FIG. 3 shows an example of an acoustic scene comprising different distant and close ranges around a position of a listener reproduced by an audio reproduction arrangement according to the invention.

FIG. 3 shows an example of an acoustic scene 2 with different distant and close ranges D1 to Dn and C0 to Cm and with at least one basic effect range B0 around at least one distant range D1 and one proximity effect range P0 around at least one close range C0 created by basic effect channels BEC1, BEC2 and proximity effect channels PEC1, PEC2 of an audio reproduction arrangement 8 (an example shown in FIG. 6) at the headphone channels CH1, CH2 of the headphone assembly 3. The created basic effect range B0 and the proximity effect range P0 give the listener L around his position X in the acoustic scene 2 a basic system perception and a proximity system perception as described below in further detail.

Figure 4:
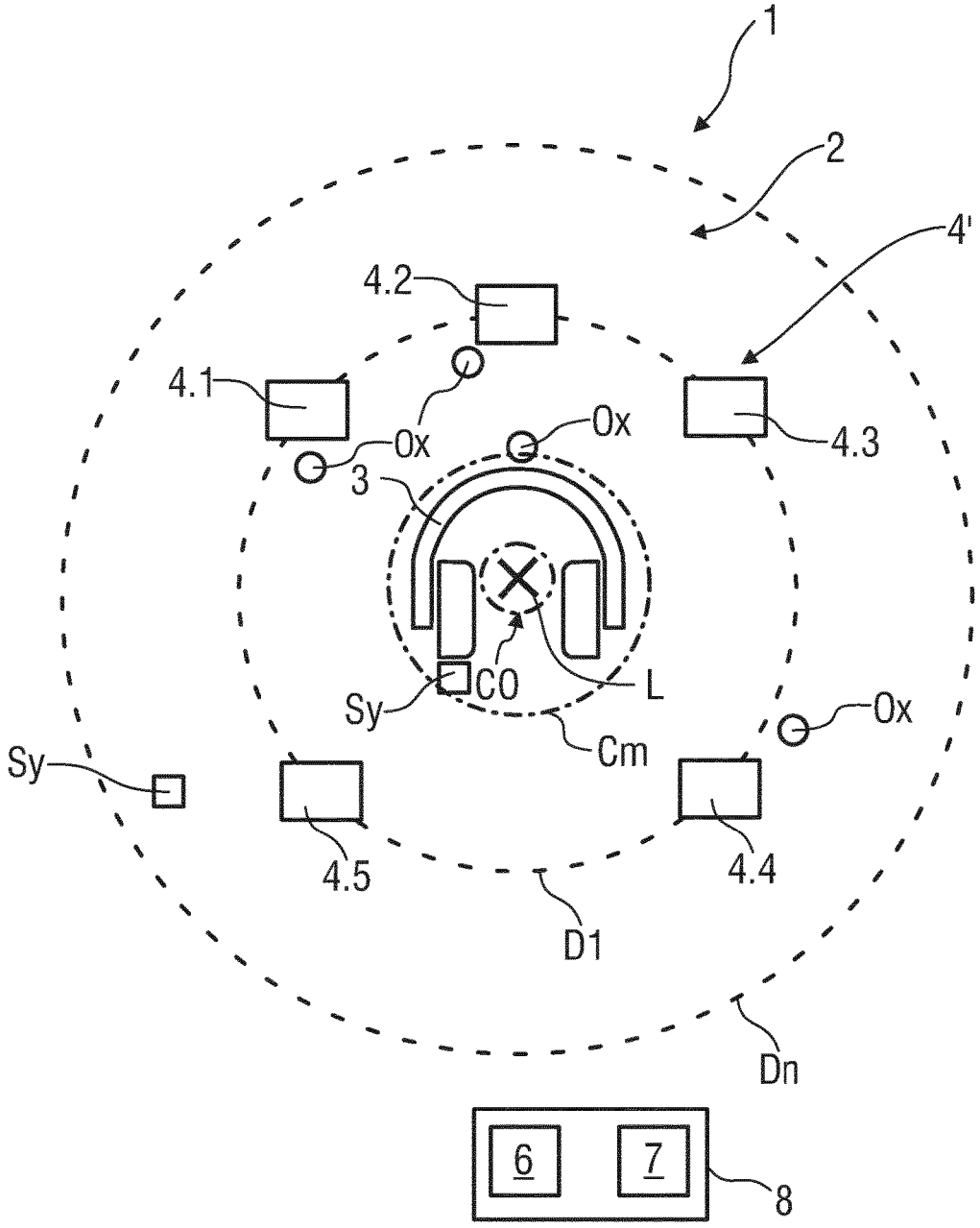
FIG. 4 shows another exemplary embodiment of an environment of an acoustic scene comprising different distant and close ranges around a position of a listener wherein the acoustic scene is reproduced on a headphone assembly and on a spatially or distantly arranged basic system formed as a surround system.
Figure 5:
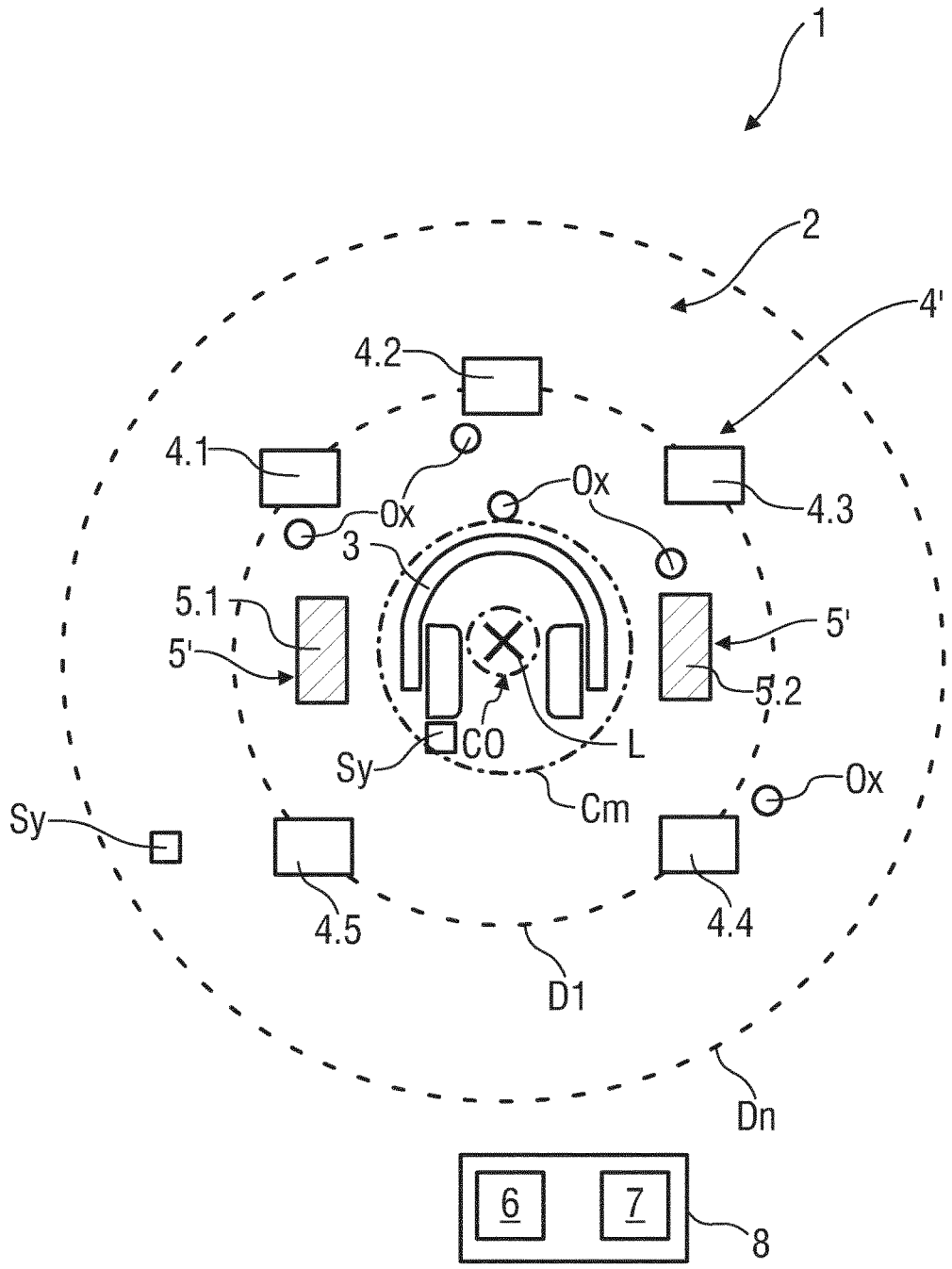
FIG. 5 shows another exemplary embodiment of an environment of an acoustic scene comprising different distant and close ranges around a position of a listener wherein the acoustic scene is reproduced on a headphone assembly and on a spatially or distantly arranged basic system formed as a surround system and on a spatially or distantly arranged proximity system formed as a sound bar.

FIGS. 4 to 5 show alternative embodiments which comprise as an audio reproduction system 8 a headphone assembly 3 in combination with a further, spatially or distantly arranged basic system 4' (FIG. 4) and a headphone assembly 3 in combination with a further spatially or distantly arranged basic system 4' and a further, spatially or distantly arranged proximity system 5' (FIG. 5).

According to the invention, the audio reproduction system comprises in the simplest form only a headphone assembly 3 with a first basic system 4 designed as a HRTF/BRIR based basic system simulating e.g. a virtual surround system and a first proximity system 5 designed as a HRTF/BRIR based proximity system or a direct audio signals based proximity system simulating e.g. a virtual proximity system, e.g. sound bars.

In the case of an open-backed headphone, e.g. open-backed headphone allowing air circulation, the audio reproduction system may additionally comprise the further basic system 4' as it is shown in FIG. 4. The exemplary shown further basic system 4' is designed as a surround system, e.g. a 5.1 or 7.1 surround system. The shown surround system comprises five loudspeakers 4.1 to 4.5. Alternatively, the surround system may comprise three, four or more loudspeakers and may be designed as a 3D surround system with a respective number of loudspeakers and a speaker array/arrangement. Further, a simple design of a further basic system 4 is a stereo audio system with two loudspeakers.

During operation of the audio reproduction system, audio objects Ox and/or sound sources Sy panned to the close ranges C0 to Cm are generated by the headphone assembly 3 wherein audio objects Ox and/or sound sources Sy panned to the distant ranges D1 to Dn are generated by the further basic system 4'. In particular, depending on the position of the audio objects Ox and/or of the sound sources Sy in the acoustic scene 2, the audio object Ox and/or the sound source Sy may be generated with different panning information, e.g. different intensity, to create that audio object Ox and/or that sound sources Sy within and/or between the respective close or distant ranges C0 to Cm, D1 to Dn by driving the headphone assembly 3 as well as driving the further basic system 4' accordingly. Thus, different proximity sound effects in a close range C0 to Cm are generated by the headphone assembly 3 as well as different distant sound effects in a distant range D1 to Dn are generated by the further basic system 4'.

FIG. 5 shows an audio reproduction system comprising a headphone assembly 3 in combination with a further basic system 4' and a further proximity system 5'. The further proximity system 5' is formed as a sound bar 5.1, 5.2. Each of the sound bars 5.1, 5.2 comprises a plurality of loudspeakers arranged to produce sounds in a close distance to the listener L.

According to another exemplary embodiment, the acoustic scene 2 which is to be reproduced may be designed as an acoustic scene with audio objects Ox and/or sound sources Sy panned to at least one close range C0 to Cm generated by the headphone assembly 3 (driven by HRTF/BRIR based proximity system and/or direct audio signals) and/or by the real sound bar 5.1, 5.2 and with audio objects Ox and/or sound sources Sy panned to at least one distant range D1 to Dn generated by the further basic system 4' and/or the computer-implemented HRTF/BRIR based basic system 4 of the headphone assembly 3.

In particular, the different audio reproduction units may be assigned to one of the acoustic distant and close ranges D1 to Dn, C0 to Cm to reproduce distant or basic effects as well as close or proximity effects for the listener L. For example, a HRTF/BRIR based proximity system 4 of the headphone assembly 3 may be adapted to create a first close range C0 to generate proximity sound effects in the respective first close range C0; the further proximity system 5', e.g. the sound bar 5.1, 5.2, may be adapted to create a second close range Cm to generate proximity sound effects in the respective second close range Cm; the further basic system 4', e.g. a surround system, may be adapted to create a first distant range D1 to generate distant sound effects in the first distant range D1 and the HRTF/BRIR based basic system 4 of the headphone assembly 3 may be adapted to create a second distant range D2 to generate distant sound effects in the second distant range D2.

Figure 6:
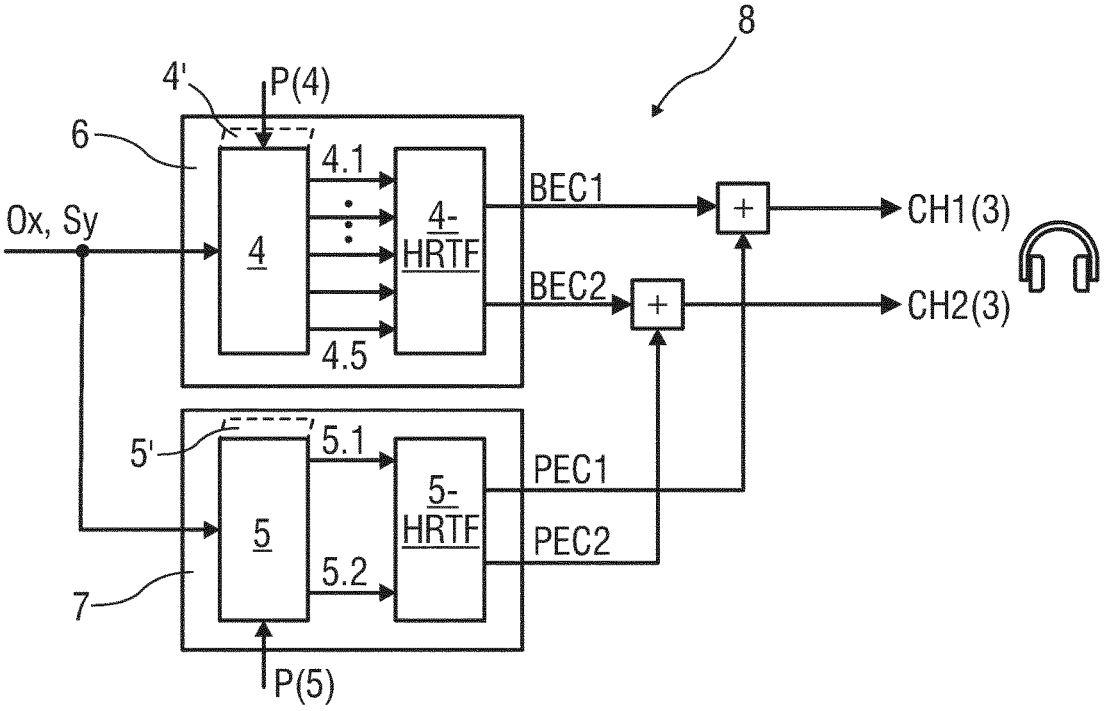
FIG. 6 shows a possible embodiment of an arrangement for providing a first headphone channel and a second headphone channel to a headphone assembly.

According to the invention in the embodiment with only a headphone assembly 3 which forms a multi-depth headphone, the headphone assembly 3 is driven by an audio reproduction arrangement 8 for driving a first headphone channel CH1 and a second headphone channel CH2 of a headphone assembly 3 as it is shown in an exemplary embodiment in FIG. 6.

In case that additional to the headphone assembly 3 a further basic system 4' (e.g. a surround system shown in FIG. 4) and/or a further proximity system 5' (e.g. a focus bar shown in FIG. 5) are used the audio reproduction arrangement 8 additionally comprises the respective basic system 4' and the respective proximity system 5' (shown in FIG. 6 with a dotted line).

FIG. 6 shows a possible embodiment of an audio reproduction arrangement 8 for driving a first headphone channel CH1, e.g. a left headphone channel, and a second headphone channel CH2, e.g. a right headphone channel, of a headphone assembly 3.

The audio reproduction arrangement 8 comprises a basic channel provider 6 and a proximity channel provider 7.

The basic channel provider 6 as well as the proximity channel provider 7 are fed with audio data, e.g. the data stream or sound of at least one audio object Ox and/or of at least one sound source Sy, of the acoustic scene 2.

The basic channel provider 6 allows the reproduction of audio data in the distant ranges D1 to Dn on both headphone channels CH1, CH2 for a basic system perception. In particular, the basic channel provider 6 comprises a virtual or real basic system 4, e.g. a surround system with a plurality of loudspeakers 4.1 to 4.5, and a HRTF/BRIR based basic system 4-HRTF for reproduction and thus perception of the basic system 4 at the headphone channel CH1, CH2.

The proximity channel provider 7 allows the reproduction of audio data in the close ranges C0 to Cm on both headphone channels CH1, CH2 for a proximity system perception. In particular, the proximity channel provider 7 comprises a virtual or real proximity system 5, e.g. loudspeaker or sound bars 5.1 to 5.2, and a HRTF/BRIR based proximity system 5-HRTF for reproduction and thus perception of the proximity system 5 at the headphone channel CH1, CH2.

Furthermore, each provider 6, 7, in particular the respective basic system 4 and the respective proximity system 5 are additionally fed with panning information P4, P5, e.g. the distance r and/or the angular position α of the audio object Ox and/or of the sound source Sy relative to the listener L.

According to the panning information P4, the audio data, e.g. the sound of the audio object Ox and/or of the sound source Sy in a respective far distance r, are processed by the virtual or real basic system 4 of the basic channel provider 6 to create the distant ranges D1 to Dn of the acoustic scene 2 by providing first and second basic effect channels BEC1, BEC2 for the first and second headphone channels CH1, CH2.

According to the panning information P5, the audio data, e.g. the sound of the audio object Ox and/or of the sound source Sy in a respective close distance r, are processed by the virtual or real proximity system 5 of the proximity channel provider 7 to create the close ranges C0 to Cm of the acoustic scene 2 by providing first and second proximity effect channels PEC1, PEC2 for the first and second headphone channels CH1, CH2.

The basic channel provider 6 is configured to provide the first basic effect channel BEC1 and the second basic effect channel BEC2 using the HRTF/BRIR based basic system 4-HRTF for processing the audio data of the distant audio object Ox and/or the distant sound source Sy to create the distant ranges D1 to Dn at the first and second headphone channels CH1, CH2.

The proximity channel provider 7 is configured to provide a first proximity effect channel PEC1 and a second proximity effect channel PEC2 using a HRTF/BRIR based proximity system 5-HRTF for processing the audio data of the close audio object Ox and/or the close sound source Sy to create the close ranges C0 to Cm at the first and second headphone channel CH1, CH2.

In other words, the basic channel provider 6, in particular the basic system 4 with the HRTF/BRIR based basic system 4-HRTF is a virtual computer-implemented audio system, using respective head related transfer functions (HRTF) and/or binaural room impulse responses (BRIR) to provide an audio signal for panning the audio object Ox and/or the sound source Sy to a respective angular position and with a respective intensity within a given distant range D1 to Dn or between the distant ranges D1 to Dn of the listener L for the respective first and second headphone channels CH1, CH2.

For positioning specific sound effects nearest to the ear of the listener L, the proximity channel provider 7 is alternatively designed as a direct audio signal based proximity system 5 configured to consider the characteristics of each respective close audio object Ox and/or sound source Sy to create the close ranges C0 to Cm as it is described in FIG. 2 and to provide a first proximity effect channel PEC1 and a second proximity effect channel PEC2 for the first and second headphone channels CH1, CH2.

To combine and create the distant and close sound effects of the acoustic scene 2 in the headphone assembly 3, the generated audio signals of the first basic effect channel BEC1 and of the first proximity effect channel PEC1 as well as the generated audio signals of the second basic effect channel BEC2 and of the second proximity effect channel PEC2 are combined to provide and drive the first headphone channel CH1, e.g. for the left ear of the listener L, and the second headphone channel CH2, e.g. for the right ear of the listener L.

In particular, the generated audio signals of the virtual or real acoustic scene 2 for the respective first and second headphone channels CH1 and CH2, e.g. for the left headphone channel and the right headphone channel, and/or for the virtual or real spatially or distantly arranged basic system 4 and/or for the virtual or real spatially or distantly arranged proximity system 5, give a multidimensional, e.g. a 2D or 3D, distant and close hearing impression to the listener L via the headphone assembly 3 and possibly via the other audio reproduction systems, e.g. the surround system and/or the sound bars 5.1, 5.2, in such a manner that the audio signals of an audio object Ox and/or a sound source Sy positioned far away from the listener L is created with more distant sound effect in a distant range D1 to Dn by driving at least one of the basic system 4, 4' (HRTF/BRIR based basic system 4 of the headphone assembly 3 and/or the surround system 4') and thus more away from the listener L and that the audio signals of an audio object Ox and/or a sound source Sy positioned close to the listener L is created with more proximity effect in a close range C0 to Cm by driving at least one of the proximity system 5, 5' (HRTF/BRIR based proximity system 5 of the headphone assembly 3 and/or the further proximity system 5' with the sound bars 5.1, 5.2) and thus more closer to the listener L.

Furthermore, the direction and/or the angular position α from which the audio signals are generated in the acoustic scene 2, e.g. away from the left ear or away from the right ear of the listener L, is considered in such a manner, that the audio signals are accordingly processed by the basic channel provider 6 as well as by the proximity channel provider 7 to drive the headphone channels CH1 or CH2 with different intensity so that natural perception is achieved.

Furthermore, the direction and/or the angular position α from which the audio signals are generated in the acoustic scene 2, e.g. away from the left ear or away from the right ear of the listener L, is considered in such a manner, that the audio signals are accordingly processed by the basic channel provider 6 as well as by the proximity channel provider 7 to drive the headphone channels CH1 or CH2 with different intensity so that natural distant and proximity perception is achieved.

Figure 7:
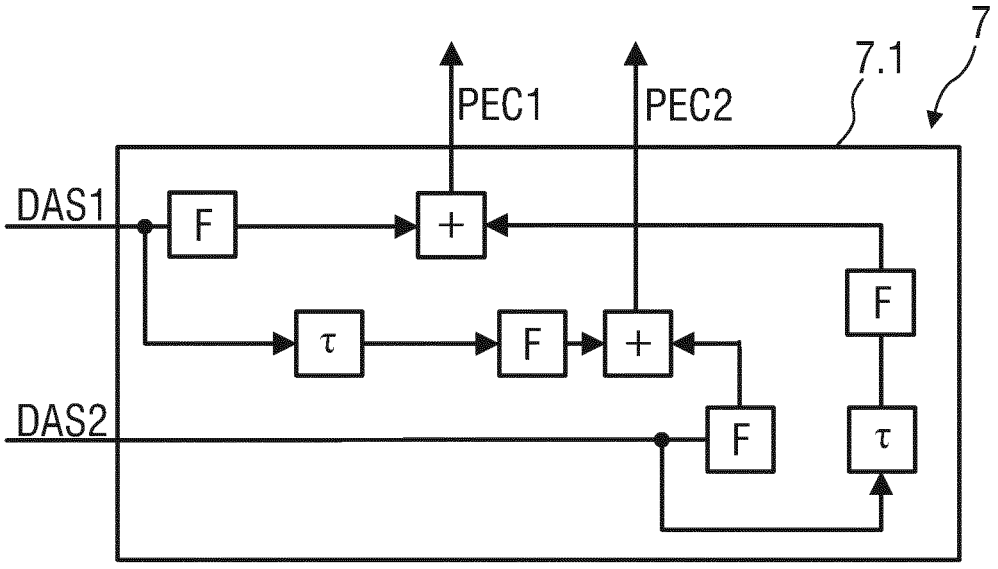
FIG. 7 shows an alternative embodiment of a HRTF/BRIR-based proximity system for providing a first proximity effect channel and a second proximity effect channel to a headphone assembly.

FIG. 7 shows as an alternative embodiment of the HRTF/BRIR based proximity system 5-HRTF (shown in FIG. 6) a processing unit 7.1 of a proximity channel provider 7 of an audio reproduction arrangement 8 for providing a first headphone channel CH1 and a second headphone channel CH2 to a headphone assembly 3.

The proximity channel provider 7 is adapted to calculate and process the direct audio signals DAS1, DAS2 of close audio objects Ox and/or close sound source Sy, e.g. of the virtual proximity system 5 or the further proximity system 5', in particular from the sound bars 5.1, 5.2, for providing first and second proximity effect channels PEC1, PEC2 to create the close range C0 to Dm to the listener L for the respective first and second headphone channels CH1, CH2.

The processing unit 7.1 adapts the direct audio signals DAS1, DAS2 for the first and second proximity effect channels PEC1, PEC2 to achieve a more natural perception.

In particular, the processing unit 7.1 comprises respective filters F, e.g. frequency filters, and time delays τ and signal adder or combiner "+" processing the direct audio signal DAS1, DAS2 of an audio object Ox or a sound source Sy to drive the proximity effect channels PEC1, PEC2 to create the close ranges C0 to Cm in such a manner that the audio object Ox or the sound source Sy is panned to a respective angular position and with a respective intensity in the close range C0 to Cm for the respective headphone channel CH1, CH2.

In more detail, for a sound source Sy or an audio object Ox in a space of an acoustic scene 2 coming from the right side of the listener L, the processing unit 7.1 is adapted to generate an audio signal for both headphone channels CH1, CH2 and thus for the first and second proximity effect channels PEC1 and PEC2, wherein the audio signal for the respective right channel, e.g. PEC1 and CH1, is created in particular with more intensity than for the left channel, e.g. PEC2 and CH2 or vice versa. By that difference of intensities the path of the sound waves through the air is considered and a natural perception is achieved at the ears of the listener L.

Additionally, but not further shown, the audio reproduction arrangement 8 may provide further effect channels for a further spatially or distantly arranged basic system 4' and/or a further proximity system 5' with sound bars 5.1, 5.2.

Furthermore, the audio reproduction arrangement 8 may comprise more than one basic channel provider 6 and more than one proximity channel provider 7, in particular for each audio system one separate channel provider.

LIST OF REFERENCES

1 environment
2 acoustic scene
3 headphone assembly
4 basic system
4-HRTF HRTF and/or BRIR based basic system
4' further basic system
4.1 . . . 4.5 loudspeakers
5 proximity system
5' further proximity system
5.1 . . . 5.2 sound bars
6 basic channel provider
5-HRTF HRTF and/or BRIR based proximity system
7 proximity channel provider
7.1 delay unit
8 audio reproduction arrangement
BEC1 first basic effect channel
BEC2 second basic effect channel
BRIR binaural room impulse response
C0 . . . Cm close range
CH1 first headphone channel
CH2 second headphone channel
D1 . . . Dn distant range
DAS1 first direct audio signal
DAS2 second direct audio signal
F filter
HRTF head related transfer function
L Listener
Ox audio object
PEC1 first proximity effect channel
PEC2 second proximity effect channel
r distance
Sy sound source
τ time delay
α angular position

The invention claimed is:

1. An arrangement for reproducing audio data of an acoustic scene in a given environment, with the arrangement adapted for generating audio signals for at least a first headphone channel and a second headphone channel of a headphone assembly, with the audio signals corresponding to at least one audio object and/or sound source in the acoustic scene comprising at least one given close range and at least one given distant range arranged around a listener such that any of the at least one distant ranges is farther away from the listener than any of the at least one close ranges, wherein the arrangement comprising:

a first headphone channel;

a second headphone channel;

a basic channel provider comprising at least a basic system adapted for reproducing audio signals corresponding to at least one audio object and/or sound source arranged in at least one distant range; and a proximity channel provider comprising at least a proximity system adapted for reproducing audio signals corresponding to at least one audio object and/or sound source arranged in at least one close range, wherein the basic channel provider is configured to provide a first basic effect channel and a second basic effect channel of the basic system to create at least one basic audio signal corresponding to at least one distant range, wherein the proximity channel provider is configured to provide a first proximity effect channel and a second proximity effect channel of the proximity system to create at least one proximity audio signal corresponding to at least one close range, wherein the first headphone channel is driven simultaneously by the first basic effect channel and the first proximity effect channel, wherein the second headphone channel is driven simultaneously by the second basic effect channel and the second proximity effect channel, wherein the basic system and the proximity system are adapted to process panning information indicating the position of the same audio object and/or the same sound source in the acoustic scene by panning this audio object and/or this sound source between the basic system and the proximity system.

2. The arrangement according to claim 1, wherein the basic system and the proximity system are adapted to process panning information of the same audio object and/or the same sound source by panning this audio object and/or this sound source between the basic system and the proximity system in such a manner that this audio object and/or this sound source is panned within one of the close or distant ranges or between different ranges.

3. The arrangement according to claim 1, wherein the basic system comprises head related transfer functions and/or binaural room impulse responses based basic system) wherein the basic channel provider is a 2D or 3D channel provider adapted to provide the first and second basic effect channels using respective head related transfer functions and/or binaural room impulse responses to generate an audio signal for the respective first and second headphone channels, the audio signal being adapted for panning at least one audio object and/or at least one sound source in at least one distant range of the listener.

4. The arrangement according to claim 1, wherein the proximity system comprises head related transfer functions and/or binaural room impulse responses based proximity system wherein the proximity channel provider is a 2D or 3D channel provider is adapted to provide the first and second proximity effect channels using respective head related transfer functions and/or binaural room impulse responses to generate an audio signal for the respective first and second headphone channels, the audio signal being adapted for panning at least one audio object and/or from at least one sound source in at least one close range of the listener.

5. The arrangement according to claim 1, wherein the basic system is a surround system with at least four loudspeakers in the given environment, wherein the basic channel provider is a surround channel provider for providing the first and second basic effect channels by generating an audio signal for the respective loudspeakers of the surround system corresponding to at least one audio object and/or from at least one sound source panned to at least one distant range.

6. The arrangement according to claim 1, wherein the proximity system is at least one sound bar comprising a plurality of loudspeakers.

7. A method for reproducing audio data of an acoustic scene in a given environment, with the method adapted for generating audio signals for at least a first headphone channel and a second headphone channel of a headphone assembly, with the audio signals corresponding to at least one audio object and/or at least one sound source in a given environment, the method comprising:

subdividing the acoustic scene and/or the environment into at least one distant range and at least one close range arranged around a listener;

creating at least one basic audio signal corresponding to at least one distant range by a basic channel provider configured to provide a first basic effect channel and a second basic effect channel of a basic system;

creating at least one proximity audio signal corresponding to at least one close range by a proximity channel provider configured to provide a first proximity effect channel and a second proximity effect channel of a proximity system;

driving a first headphone channel simultaneously with the first basic effect channel and the first proximity effect channel; and driving a second headphone channel simultaneously with the second basic effect channel and the second proximity effect channel, wherein the basic system and the proximity system process panning information indicating a position of the same audio object and/or the same sound source in the acoustic scene by panning this audio object and/or this sound source between the basic system and the proximity system.

8. The method according to claim 7, wherein panning information of the same audio object and/or the same sound source are processed by the basic system and the proximity system for panning this audio object and/or this sound source between the basic system and the proximity system.

9. The method according to claim 8, wherein panning information of the same audio object and/or the same sound source are processed in such a manner that this audio object and/or this sound source is panned within one of the close or distant ranges or between different ranges.

10. The method according to claim 7, wherein the basic channel provider formed as a 2D or 3D channel provider provides the first and second basic effect channels using respective head related transfer functions and/or binaural room impulse responses to generate an audio signal for the respective first and second headphone channels, with the audio signal adapted for panning at least one audio object and/or at least one sound source in a respective distant range.

11. The method according to claim 7, wherein the proximity channel provider formed as a 2D or 3D channel provider provides the first and second proximity effect channels using respective head related transfer functions and/or binaural room impulse responses to provide an audio signal for panning at least one audio object and/or at least one sound source in at least one close range of a listener for the respective first and second headphone channels.

12. The method according to claim 7, wherein the basic channel provider is additionally formed as a surround channel provider for a surround system with a given number of loudspeakers provides the first and second basic effect channels by generating an audio signal for panning at least one audio object and/or from at least one sound source in a respective distant range of a listener.

13. A non-transitory computer-readable recording medium having a computer program for executing the method according to claim 7.

* * * * *